US007574164B2

(12) United States Patent
Okada et al.

(10) Patent No.: US 7,574,164 B2
(45) Date of Patent: Aug. 11, 2009

(54) DEVELOPING DEVICE AND ELECTROPHOTOGRAPHIC APPARATUS USING THE SAME

(75) Inventors: Hisao Okada, Ibaraki (JP); Hiroyuki Mabuchi, Ibaraki (JP); Teruaki Mitsuya, Ibaraki (JP); Tsuneaki Kawanishi, Ibaraki (JP); Akio Tsujita, Ibaraki (JP)

(73) Assignee: Ricoh Company Ltd., Tokyo (JP)

( * ) Notice: Subject to any disclaimer, the term of this patent is extended or adjusted under 35 U.S.C. 154(b) by 351 days.

(21) Appl. No.: 11/233,120

(22) Filed: Sep. 23, 2005

(65) Prior Publication Data

US 2007/0172262 A1 Jul. 26, 2007

(30) Foreign Application Priority Data

Sep. 24, 2004 (JP) ..... P2004-276695

(51) Int. Cl.
*G03G 15/09* (2006.01)
*G03G 9/00* (2006.01)

(52) U.S. Cl. ..... 399/269; 430/111.1; 430/111.3

(58) Field of Classification Search ..... 430/111.1, 430/111.3, 111.31, 111.32, 111.33, 111.34; 399/252, 259, 269
See application file for complete search history.

(56) References Cited

U.S. PATENT DOCUMENTS 4,873,551 A 10/1989 Tajima et al.
5,116,711 A * 5/1992 Kobayashi et al. .. 430/111.32 X
5,565,291 A * 10/1996 Mayama et al. ..... 430/111.34
5,885,742 A * 3/1999 Okado et al. ..... 430/111.1
5,923,933 A * 7/1999 Anzai et al. ..... 399/269
6,500,595 B1 * 12/2002 Mochizuki et al. ..... 430/111.1
6,813,462 B2 * 11/2004 Mitsuya et al. ..... 399/269
6,993,274 B2 * 1/2006 Hirobe ..... 399/269

FOREIGN PATENT DOCUMENTS

| | | |
|---|---|---|
| JP | 63-225262 | 9/1988 |
| JP | 5-61271 | 3/1993 |
| JP | 7-98521 | 4/1995 |
| JP | 07-062779 | 7/1995 |
| JP | 7-62779 | 7/1995 |
| JP | 10-232562 | 9/1998 |
| JP | 2001-312103 | 11/2001 |
| JP | 2002-123043 | 4/2002 |
| JP | 3418604 | 4/2002 |
| JP | 2004-069807 | 3/2004 |
| JP | 2004-151358 | 5/2004 |

OTHER PUBLICATIONS

Japanese Office Action dated Apr. 14, 2009 with English Translation.

* cited by examiner

*Primary Examiner*—Sandra L Brase
(74) *Attorney, Agent, or Firm*—McGinn IP Law Group, PLLC

(57) ABSTRACT

An electrophotographic apparatus includes: a photoconductor; and two developing rollers facing the photoconductor. A developer fed out from between the two developing rollers is supplied to the photoconductor by the two developing rollers to form a toner image on the photoconductor. The developer includes a carrier having a volume-average particle size smaller than 70 μm and a volume resistivity not lower than $10^6$ Ω·cm. A volume ratio of the carrier in a facing portion between the photoconductor and the developing rollers is not lower than 30% and not higher than 46%.

19 Claims, 4 Drawing Sheets

DEVELOPING DEVICE AND ELECTROPHOTOGRAPHIC APPARATUS USING THE SAME

The present application is based on Japanese Patent Application No. 2004-276695 filed on Sep. 24, 2004, the entire contents of which are incorporated herein by reference.

BACKGROUND OF THE INVENTION

1. Field of the Invention

The present invention relates to a developing device using a two-component developer composed of a carrier and a toner, and an electrophotographic apparatus using the developing device.

2. Description of the Related Art

Electrophotographic apparatuses such as a copying machine, a printer, etc. using electrophotography have become essential to current business. This type electrophotographic apparatus operates as follows. After a photoconductor is electrically charged, the photoconductor is exposed to light in accordance with image data so that an electric charge distribution corresponding to an image pattern is formed on the photoconductor. When toner is developed in accordance with the electric charge distribution, a toner image first appears as a visible image. The toner image is then transferred onto a sheet of paper and thermally fixed on the sheet of paper. Thus, the formation of an image is completed.

In this development, there is used a developing method using a two-component developer as a mixture of a toner of colored particles of resin powder having a particle size of from 5 to 10 μm and a carrier of magnetic particles of ferrite, magnetite or iron powder having a mean particle size of from 30 to 100 μm, or a developing method using a one-component developer having magnetic powder in a toner without using a carrier. In the electrophotographic apparatus using a two-component developer, the developer is carried to a space (developing portion) where the photoconductor faces a developing roll having a magnet, by the developing roll so that toner is developed on the photoconductor. As the developing roll, there is commonly used a developing roll having a structure in which a magnet roll is provided on the inside of a cylindrical sleeve roll. On the other hand, an electrophotographic apparatus using a plurality of such developing rolls is known. Achievement of high printing quality is required of the electrophotographic apparatus. Therefore, various measures have been tried to the developer and the developing device.

For example, there is known a technique in which the resistivity of the carrier and the carrier loading rate in the developing portion are limited so that the carrier resistance and the loading rate are set to be in proper ranges respectively by an AC developing bias to thereby prevent beads carry over (a phenomenon that the carrier is deposited on the photoconductor) and white dotting in a solid image (e.g. Japanese Published examined application Hei. 7-062779).

There is also known a technique in which the carrier resistance, the frequency of the AC developing bias and the volume-average particle size of the toner are combined properly to thereby obtain an image free from fogging and rear end missing and good in graininess (e.g. Japanese Patent No. 2768078).

There is known a further technique in which the carrier particle size is reduced to bring the particle size distribution and the specific surface area based on an air permeation method to proper ranges respectively to thereby prevent lowering of image density and blurring at the time of continuous copying of a large-area image (e.g. Japanese Patent 3029180).

There is known a further technique in which a developing device having a combination of two developing rolls different in the direction of movement relative to a surface of the photoconductor is used to prevent rear end missing of an image (e.g. JP-A-10-232562).

There is known a further technique in which a ferrite carrier having a core material of iron oxide having magnesium oxide and/or manganese oxide as a subsidiary component is used in a high-speed printer using a plurality of developing rolls to achieve a two-component developing method/developer of high quality and long life (e.g. Japanese Patent 3418604).

These background-art techniques are however insufficient to reduce the size of the developing device in the high-speed printing electrophotographic apparatus. For example, there are problems that sufficient print density cannot be obtained because the amount of toner carried to the developing portion is reduced in order to suppress the carrier loading rate in the developing portion, that rear end missing occurs at high-speed printing, that high image quality cannot be achieved though rear end missing is prevented, and that rubbing irregularity of the carrier appears in the image when the carrier used has a large mean particle size of 110 μm. If the size of the developing device is increased to keep the print density high, it is difficult to handle such a large-size developing device because the large-size developing device can be hardly held by human hands.

SUMMARY OF THE INVENTION

It is an object of the invention to provide an electrophotographic apparatus which performs high-speed printing by using a two-component developer and in which both high-quality printing with sufficient print density and reduction in size of a developing device can be achieved.

According to an aspect of the invention, there is provided with an electrophotographic apparatus includes: a photoconductor; and two developing rollers facing the photoconductor. A developer fed out from between the two developing rollers is supplied to the photoconductor by the two developing rollers to form a toner image on the photoconductor. The developer includes a carrier having a volume-average particle size smaller than 70 μm and a volume resistivity not lower than $10^6$ Ω·cm. A volume ratio of the carrier in a facing portion between the photoconductor and the developing rollers is not lower than 30% and not higher than 46%.

According to the above-aspect of the invention, a small-size developing device free from rear end missing and rubbing irregularity of a carrier and exhibiting high quality and sufficient print density can be used for achieving an electrophotographic apparatus using a two-component developer for performing high-speed printing.

DESCRIPTION OF THE PREFERRED EMBODIMENTS

Figure 1:
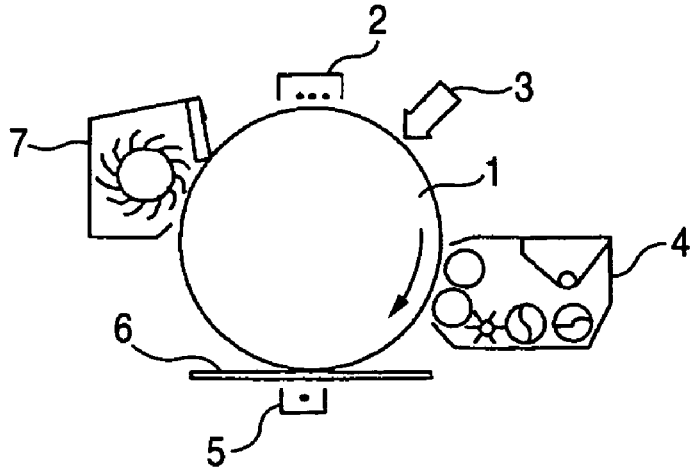
FIG. 1 is a typical view of an electrophotographic apparatus according to an embodiment of the invention.

To keep high quality and sufficient print density in a small-size developing device free from rear end missing and carrier rubbing irregularity, a carrier having a volume-average particle size not larger than 70 μm and exhibiting an optimized electric resistance value is used in combination with a developing device having two developing rolls rotating in different directions.

An electrophotographic apparatus will be described with reference to FIG. 1.

A surface of a photoconductor 1 rotating clockwise (in the direction of the arrow) is evenly electrically charged by a charger 2. An exposure unit 3 blinks light on and off in accordance with image data so that the light is applied on the surface of the photoconductor 1. A portion of the surface of the photoconductor 1 irradiated with the light by the exposure unit 3 is made so electrically conductive that electric charge disappears from the surface. A developing device 4 forms a toner image by depositing toner on the place where electric charge disappears from the surface of the photoconductor 1. A sheet of paper 6 carried from a paper feeder not shown reaches a transfer position of a transfer unit 5. The toner image formed on the photoconductor 1 by development is transferred onto the sheet of paper 6 by the transfer unit 5. The toner image transferred onto the sheet of paper 6 is thermally melted and fixed on the sheet of paper 6 by a fixing unit not shown. Then, the sheet of paper 6 is ejected from an ejection portion of the electrophotographic apparatus. On the other hand, a part of toner not transferred onto the sheet of paper 6 but remaining on the photoconductor 1 is removed by a cleaner 7. Thereafter, the formation of an image is performed in the same manner as described above. Incidentally, a light beam scanning type exposure unit or an LED type exposure unit is known as the exposure unit 3. A fixing unit of the type using a heat roll and a pressure roll is known well as the fixing unit. A high-speed printer exhibiting a print speed of 70 pages per minute or higher is used as the elecrophotographic apparatus according to this embodiment.

The developing device 4 will be described in detail with reference to FIG. 2. A two-component developer 15 composed of a toner and a carrier is held in the developing device 4. As surfaces of developing rolls 8 and 9 each having a magnet in its inside rotate, the developer 15 is carried to a region where the developing rolls 8 and 9 face the photoconductor 1. The weight rate of toner (toner density) in the two-component developer is adjusted to be in a range of from about 3% to about 15%. A developing bias voltage of DC only or of AC superposed on DC is applied to the developing rolls 8 and 9. Toner electrically charged with the same polarity as that of the photoconductor 1 is deposited on the place where electric charge disappears from the surface of the photoconductor 1, by the action of an electric field between the photoconductor 1 and the developing rolls 8 and 9. The distance between the photoconductor 1 and the developing rolls 8 and 9 is 0.5 mm. The rate of the moving speed of the surface of the photoconductor 1 to the moving speed of the surfaces of the developing rolls 8 and 9 is 1:1.5 in terms of absolute value. The developer 15 is carried toward the developing rolls 8 and 9 by a conveyance roll 12 and further carried from the developing rolls 8 and 9 to a developing portion of the photoconductor 1 by a limiting member 10 called "doctor blade". A part of the developer not developed on the photoconductor 1 but remaining on the developing roll 8 is scraped off by a blade 11 and returned into the developing device 4 again, so that the part of the developer is agitated by agitating screws 13.

When toner is spent by development, the toner density in the developer in the developing device 4 is lowered. The lowering of the toner density is detected by a toner density sensor 16. A controller (not shown) compares the output value of the toner density sensor 16 with a predetermined value stored in a storage means included in the controller. When the toner density lower than the predetermined value is detected, toner is supplemented from a toner hopper 14 into the developing device 4. When the output of the toner density sensor 16 reaches the predetermined value of toner density, the controller stops the toner supplement to prevent the toner density in the developing device 4 from becoming excessive.

EXAMPLE 1

Figure 2:
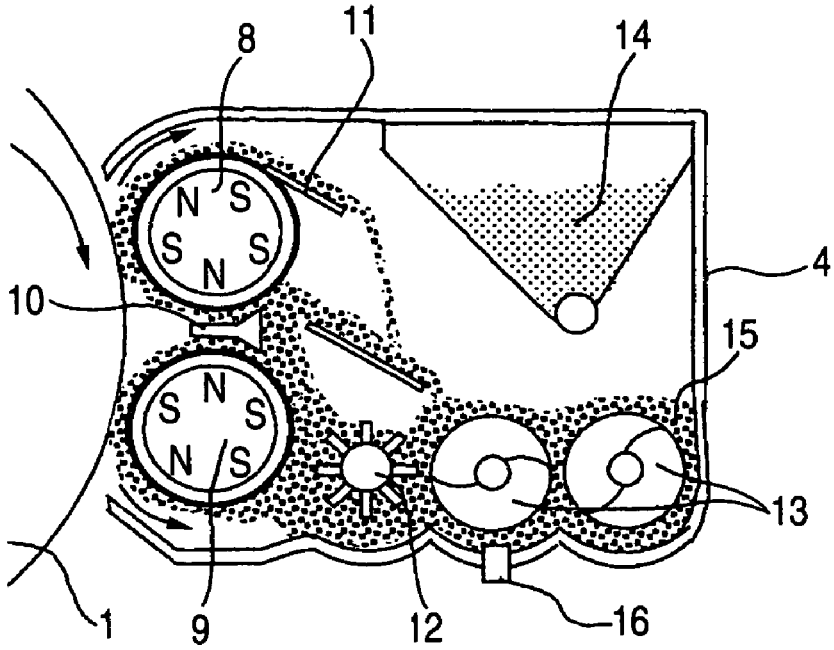
FIG. 2 is a typical view of a developing device according to an embodiment of the invention.

The developing roll 8 of the developing device 4 shown in FIG. 2 rotates so that the moving direction of the surface of the developing roll 8 is reverse to the moving direction of the surface of the photoconductor 1. Thus, the rear end portion of the image is developed well. The developing roll 9 rotates so that the moving direction of the surface of the developing roll 9 is the same as the moving direction of the surface of the photoconductor 1. Thus, the front end portion of the image is developed well. The developing device shown in FIG. 2 is effective in preventing missing of the image end portions. Moreover, because the developing device is high in developing performance, the developing device can satisfy high-speed printing. Rubbing irregularity is however apt to occur because the two developing rolls are used so that rubbing force becomes intensive. Therefore, in the developing device using two or more developing rolls, when the volume-average particle size of the carrier in the developer is selected to be not larger than 70 μm, an image free from rubbing irregularity can be obtained. Moreover, when the volume resistivity of the carrier is selected to be not lower than $10^6$ Ω·cm, injection of electric charge into the carrier can be prohibited to thereby prevent the carrier from being deposited on the photoconductor 1 to cause image transfer missing.

The deposition of the carrier is affected by magnetic force of developing magnetic poles of the developing rolls. The developing magnetic poles are magnetic poles which are provided inside the developing rolls 8 and 9 so as to face the photoconductor 1 in FIG. 2. Because the carrier is made of a magnetic substance, beads carry over caused by the deposition of the carrier on the photoconductor 1 can be suppressed when the magnetic flux density of the developing magnetic poles is increased. In this embodiment, developing magnetic poles of 0.12 T are used.

To reduce the deposition of the carrier on the photoconductor, it is important to increase the electric resistance value of the carrier so as to be not lower than a predetermined value. The volume resistivity of the carrier and the condition for the developing rolls to suppress beads carry over were examined about 19 kinds of carriers shown in Table 1 in order to confirm the absolute value of the resistance value. In Table 1, the core material symbol M shows magnetite, and G shows magnesium ferrite. In each of the carriers shown in Table 1, the surface of the carrier was coated with a silicone resin. In some carriers, an electrically conductive agent was added into the silicone resin. The resistivity of the carrier can be adjusted by the selection of the core material, the amount of coating and the amount of the electrically conductive agent added. Besides magnetite and magnesium ferrite shown in Table 1, an iron powder carrier or a binder type carrier made of a resin kneaded with magnetic powder can be used as the core material of the carrier. The iron powder carrier has no bad influence on the environment when it is leaked out of the device or abolished because there is no heavy metal included in the iron powder carrier. The binder type carrier has an advantage that a higher quality image can be printed because the binder type carrier is magnetically saturated so easily that the influence of rubbing can become smaller.

TABLE 1

| Symbol | Particle Size μm | Core Material | Amount of Coating % | Amount of Electrically Conductive Agent | Volume Resistivity (Ω · cm) 1000 V/cm | Volume Resistivity (Ω · cm) 10000 V/cm |
|---|---|---|---|---|---|---|
| MA-1 | 65 | M | 2.0 | 2 | 3.5E+14 | 2.4E+0.7 |
| MA-2 | 65 | M | 2.0 | 4 | 5.0E+14 | 2.4E+0.7 |
| MA-3 | 65 | M | 2.0 | 6 | 1.1E+14 | X |
| MA-4 | 65 | M | 2.0 | 8 | 8.6E+14 | X |
| MA-5 | 65 | M | 2.0 | 10 | 7.9E+07 | X |
| MA-6 | 65 | M | 0.6 | 10 | 1.3E+08 | X |
| MB-1 | 55 | M | 2.0 | 0 | 2.9E+14 | 1.8E+08 |
| MB-2 | 55 | M | 2.0 | 1 | 1.7E+14 | 1.2E+08 |
| MB-3 | 55 | M | 2.0 | 2 | 5.3E+14 | X |
| MB-4 | 55 | M | 2.0 | 3 | 1.7E+13 | X |
| MB-5 | 55 | M | 2.0 | 4 | 2.5E+12 | X |
| MB-6 | 55 | M | 2.0 | 5 | 6.5E+11 | X |
| MB-7 | 55 | M | 0.6 | 10 | X | X |
| MG-1 | 65 | G | 0.6 | 10 | 2.0E+13 | 2.2E+06 |
| MG-2 | 65 | G | 1.2 | 10 | 7.5E+13 | 1.4E+10 |
| MG-3 | 65 | G | 2.0 | 10 | 8.6E+12 | 1.8E+09 |
| MG-4 | 55 | G | 2.0 | 5 | 2.4E+15 | 4.8E+10 |
| MG-5 | 45 | G | 0.6 | 10 | 1.2E+14 | 3.0E+12 |
| MG-6 | 35 | G | 0.6 | 10 | 2.6E+14 | 4.9E+12 |

Figure 3:
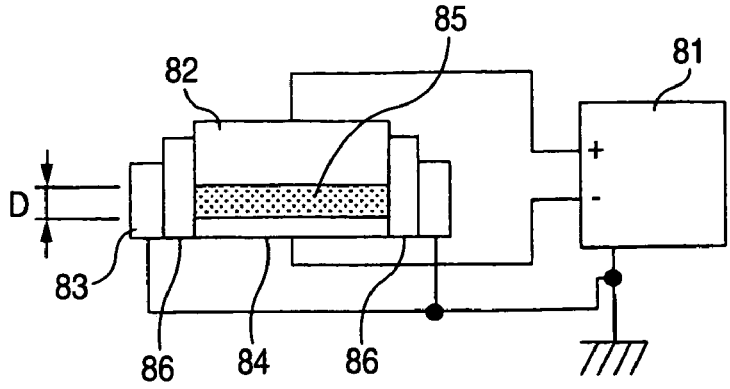
FIG. 3 is a typical view for explaining a method for measuring the volume resistivity of a carrier.

First, the method of measuring the electrical volume resistivity of the carrier will be described with reference to FIG. 3. As shown in FIG. 3, guard electrodes 83 having an inner diameter of 20 mm and an outer diameter of 40 mm are disposed so that each of the guard electrodes 83 is separated from a measurement electrode 84 (SUS disk) having a diameter of 10 mm by a 5 mm-wide electrically insulating resin 86. A carrier 85 is disposed between the electrically insulating resins 86. A measurement electrode 82 (SUS column) having a diameter of 10 mm and serving as an electrode and also as a weight is disposed on the carrier 85. A voltage is applied to the measurement electrode 82 while the guard electrodes 83 are grounded. In this condition, a high resistance meter 81 (ADVANTEST R8340A) is used for measuring a current flowing in the measurement electrode 84 and dividing the applied voltage by the current to thereby calculate a value of resistance. A weight is put on the measurement electrode 82 so that the measurement electrode 82 is weighted with 250 g/cm$^2$. The resistivity is calculated in such a manner that the product of the area of the measurement electrode 84 and the resistance value is divided by the distance D between the measurement electrode 84 and the measurement electrode 82. The thickness of the carrier 85 is set to be 1 mm. The voltage applied to the electrode 82 is set to be in a range of from 100 V to 1000 V so that the intensity of the electric field applied to the carrier is set to be in a range of from 1000 V/cm to 10000 V/cm. In this condition, resistance was measured by the high resistance meter 81.

Figure 4:
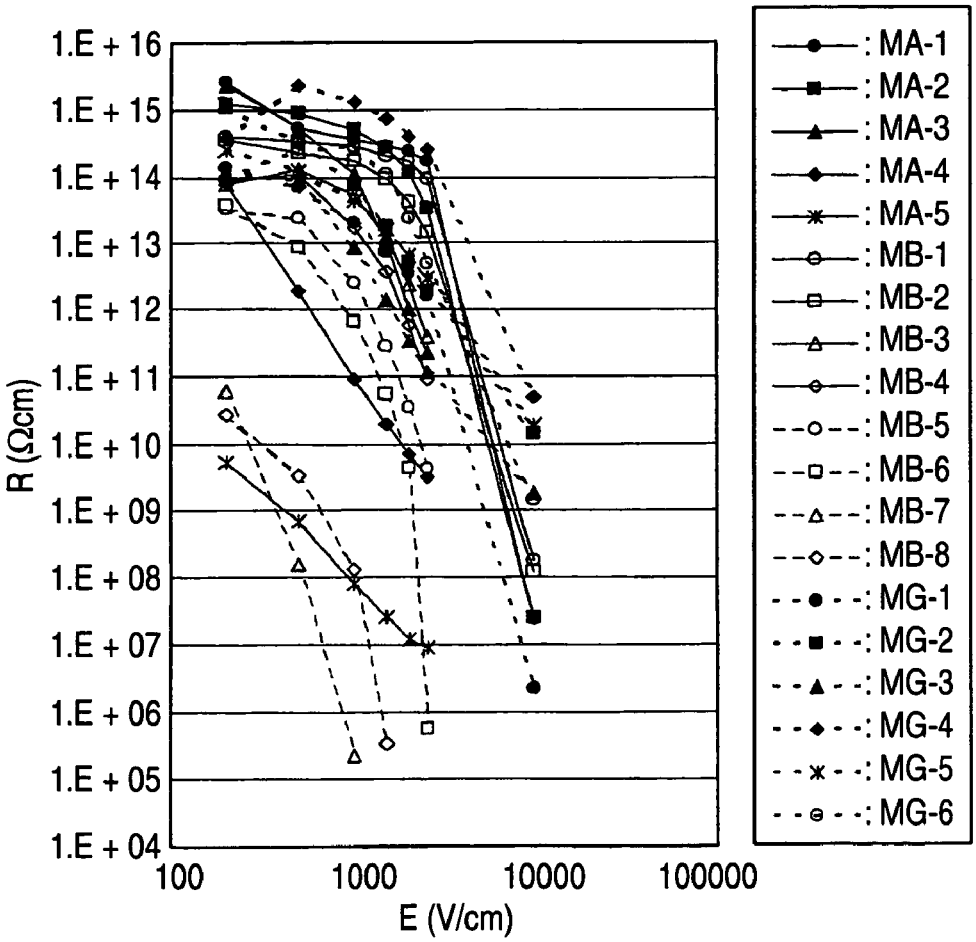
FIG. 4 is a graph for explaining the relation between the volume resistivity and the applied electric field intensity in various kinds of carriers.

FIG. 4 shows the relation between the applied electric field intensity and the volume resistivity in each of the carriers shown in Table 1. The volume resistivity R of the carrier varies according to the applied electric field intensity E. The volume resistivity R shows a tendency to decrease when the electric field intensity E becomes high. In Table 1, the carrier having X expressed as the measurement value at the applied electric field intensity of 10000 V/cm is a carrier in which the resistivity could not be measured because the carrier becomes electrically conductive at 10000 V/cm. Such a carrier causes carrier deposition because electric charge is apt to be injected into the carrier. In Table 1, the carrier designated by the symbol MG-1 exhibited the lowest volume resistivity in the case where resistance was reduced but the carrier was not electrically conductive so that the carrier deposition could be suppressed at the applied electric field intensity of 10000 V/cm.

Accordingly, when the resistance of the carrier is adjusted so that the volume resistivity of the carrier satisfies $10^6$ Ω·cm or higher at the electric field intensity of 1000/cm in the condition that the carrier is weighted with 250 g/cm$^2$, beads carry over can be suppressed. The carriers MA-1, MA-2, MB-1, MB-2 and MG-1 to MG-6 shown in Table 1 can be applied to this example.

When a mixture of a black toner having a mean particle size of 8.5 μm and a carrier having a mean particle size of 65 μm is prepared as the developer so that the toner concentration is set to be 5% and that the amount of charging of the toner is adjusted to be in a range of from 15 to 25 μC/g, an image density of 1.3 or higher in terms of optical density can be obtained even in the case where the printing speed is higher than 92 ppm because the two developing rolls are used. Moreover, when the carrier with a volume resistivity not lower than $10^6$ Ω·cm is used as described above, an image-forming apparatus free from transfer failure can be achieved.

EXAMPLE 2

When the volume rate occupied by the carrier in the space surrounded by the photoconductor 1 and the developing rolls 8 and 9 in FIG. 2 was set to be 30% or higher, an image density of 1.4 could be obtained even in the electrophotographic apparatus having a printing speed of 92 ppm.

The volume rate occupied by the carrier can be calculated in such a manner that the weight of the carrier deposited on the unit area of the developing rolls is divided by the absolute specific gravity of the carrier and the distance between the photoconductor 1 and the developing roll 8 or 9 and then multiplied by 100. Specifically, when the weight of the developer on the developing rolls, the absolute specific gravity of the carrier and the distance between the photoconductor 1 and the developing roll 8 or 9 are 0.082 g/cm$^2$, 5 g/cm$^2$ and 0.05 cm respectively, the calculated volume rate is about 31% based on 0.078/5/0.05*100 because the weight of the carrier on the developing rolls is about 0.078 g if the developer has a toner concentration of 5%. When the weight of the developer on the developing rolls is adjusted to be 0.066 g/cm$^2$, the image density at the volume rate of 25% is 1.30. When the weight of the developer on the developing rolls is adjusted to be 0.028 g/cm$^2$, the image density at the volume rate of 10% is 0.80. Accordingly, an image density of 1.4 can be obtained when the volume rate is not lower than 30%.

Incidentally, when the volume rate was higher than 46%, the influence of rubbing occurred on the image. Specifically, rear end missing that the rear end portion of the image was missing by rubbing occurred though two developing rolls rotating in different directions respectively were used in this example. It is therefore preferable that the volume rate is adjusted to be in a range of from 30% to 46%. When the volume rate is in this range, a stable image density of 1.4 can be obtained by use of the small-size developing device according to this example.

EXAMPLE 3

When the volume-average particle size of the carrier in FIG. 2 was set to be not larger than 70 μm, it was possible to obtain such a good image that the density changed sharply from the white background to the image portion.

The influence of rubbing of the carrier is apt to appear in the boundary between the white background and the image portion. Particularly when a carrier having a volume-average particle size not smaller than 80 μm is used, scraping by the carrier can be recognized so visually that the sharpness of the image is spoiled.

Figure 5:
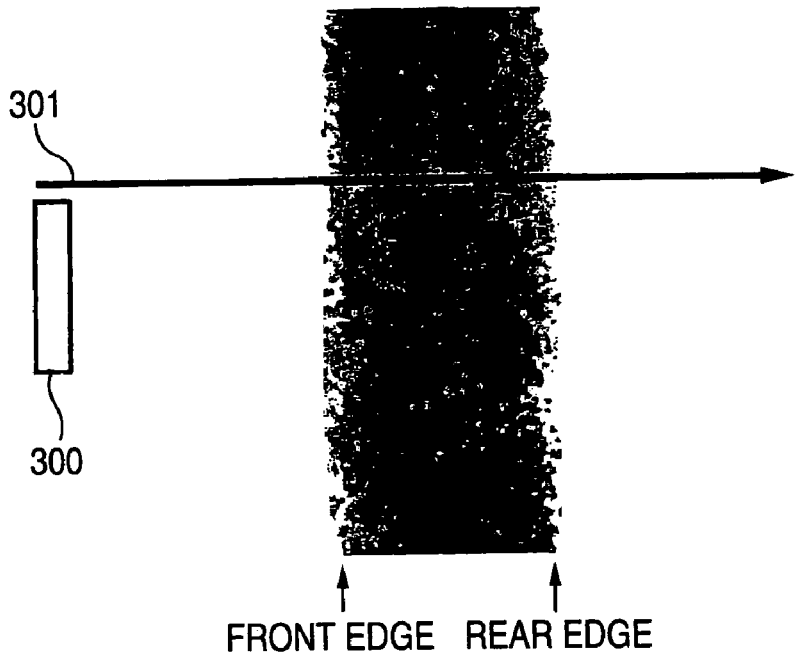
FIG. 5 is a view for explaining a method for measuring blurring of an image.
Figure 6:
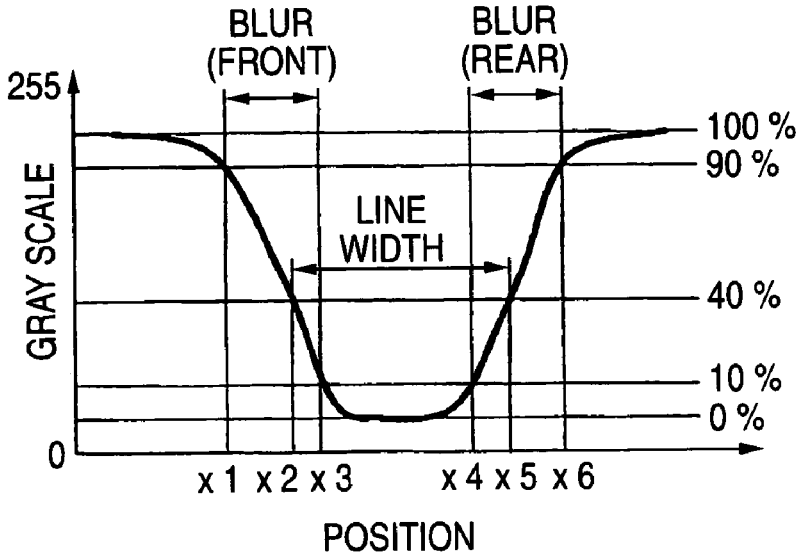
FIG. 6 is a graph for explaining the definition of blurring of an image.

The density change in the boundary between the white background and the image portion is defined as one of items for evaluating the quality of the image in terms of blurring. The density change will be described with reference to FIGS. 5 and 6. FIG. 5 shows a bar image. In FIG. 5, "front edge" shows a front end portion of the image and "rear edge" shows a rear end portion of the image. The method for evaluating blurring is defined according to the standard of JIS X6930. The method is as follows. First, the image is taken into a computer by use of a microscope (OLYMPUS BH-2 Model with a 5-power objective lens) and a CCD camera (FUJI FILM FUJIX HC-300Z with a 2.5-power lens intermediate with respect to the lens of the microscope). The image taken into the computer is converted into a gray scale image. A slit 300 (having a size of 5 pixels by 273 pixels equivalent to a size of 10 μm wide by 500 μm long) is moved from the white background to the image portion in the direction of the arrow 301 at intervals of the width of the slit 300 by a hand-made software while the lengthwise direction of the slit 300 is made parallel with the end portions of the image. In this condition, gray scale values of the image in the slit 300 are measured so that the relation of the scanning position is plotted as shown in FIG. 6. A positional distance of 40% with respect to the maximum gray scale value (100%) and the minimum gray scale value (0%) is regarded as a line width, and a positional distance where the gray scale value changes from 10% to 90% in each end portion of the image is regarded as a blurring value. When the relation between the particle size of the carrier and the blurring value was examined by this method, there was obtained a result that the blurring value decreased as the particle size of the carrier decreased. The difference in the density change could not be observed any longer by eyes when the volume-average particle size of the carrier was not larger than 70 μm. When the volume-average particle size of the carrier was 70 μm, the blurring value was 135 μm.

When the carrier was selected to accomplish a blurring value not larger than 135 μm so that the difference in blurring in the electrophotographic apparatus shown in FIG. 1 could not be recognized by eyes, a sharp image could be obtained on a sheet of paper by use of the developing device shown in FIG. 2.

EXAMPLE 4

The possibility of preventing the deposition of the carrier in the case where the volume resistivity of the carrier is set to be not lower than $10^6$ Ω·cm at the applied electric field intensity of 10000 V/cm has been described in Example 1. When the resistivity at this applied electric field intensity is set to be not higher than $10^{10}$ Ω·cm while the volume resistivity at the applied electric field intensity of 1000 V/cm is set to be not lower than $10^{12}$ Ω·cm, excessive deposition of toner on the line image can be prevented while beads carry over can be suppressed.

In the carrier having a resistivity higher than $10^{10}$ Ω·cm at the applied electric field intensity of 10000 V/cm, the amount of toner deposited on the line image is made excessive by the emphasis of the edge effect specific to the case where the high-resistance carrier is used. As a result, the influence of scattering at transferring becomes so large that the sharpness of the image is lowered. To reduce the amount of toner deposited on the line image to a proper value, it is necessary to reduce the resistivity of the carrier to a moderate value, that is, $10^{10}$ Ω·cm or lower. For this reason, the carriers MA-1, MA-2, MB-1, MB-2, MG-1 and MG-3 shown in Table 1 can be used. When any one of these carriers is used, a sharp image can be obtained because the amount of toner deposited in the line image can be reduced to a proper value while beads carry over can be suppressed.

Particularly in the carriers MG-1 and MG-3 using magnesium ferrite as a core material, the resistivity of the carrier can be kept high even in the case where the amount of the low-resistance electrically conductive agent is increased because the electrical resistance of the core material is high. Because the electrically conductive agent is effective in improving the stability of the amount of charging, use of the carrier MG-1 or MG-3 using magnesium ferrite has an advantage that the amount of charging is stabilized to thereby make the print density more stable.

EXAMPLE 5

Figure 7:
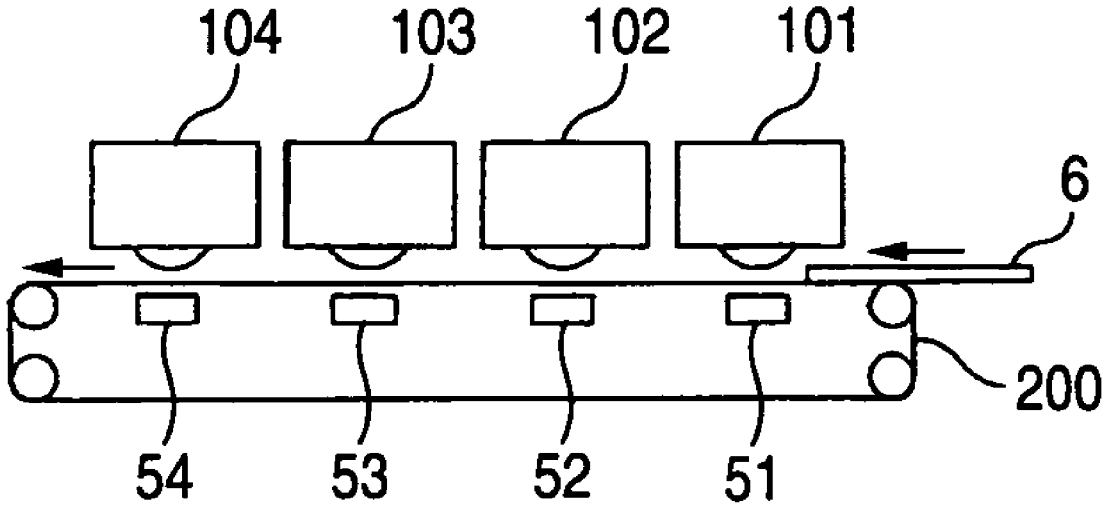
FIG. 7 is a typical view of a four-color or full-color printer.

The small-size developing device according to the embodiment of the invention is particularly suitable for use in a multi-color printer using a plurality of developing devices. FIG. 7 shows an example of a four-color printer. FIG. 7 shows the case where image-forming portions 101 to 104 each including a photoconductor, a charger, an exposure unit, a developing device, a cleaner, etc. as shown in FIG. 1 are connected continuously. Respective colors are successively transferred onto a sheet of paper 6 carried on a paper feed belt 200 by transfer units 51 to 54, so that a four-color image is printed on the sheet of paper 6. When the four colors used are yellow, magenta, cyan and black, a full-color printer can be formed. Particularly in the full-color printer for printing an image, a print density of 30% or higher per color may be required averagely and continuously. The developing device according to this invention is particularly suitable for such a purpose because a stable image density can be obtained as described in Example 2.

EXAMPLE 6

A result of application of the embodiment of the invention to a high-speed continuous paper printer will be described. The printer used in this experiment is an L160 type high-speed continuous paper printer made by Ricoh Printing Systems, Ltd. The printing speed of the printer is about 230 ppm at A4-size. The width is widened to 1.3 times compared with a printer having a printing speed of 92 ppm as shown in Example 1 or 2. The moving speed of the surface of the photoconductor is increased to twice. Even in this speed, an image density of 1.4 in terms of optical density can be obtained when the developing device according to the embodiment of the invention is used. In an experiment in which the printing speed is further increased to 500 ppm, three developing rolls are used. This is a configuration in which a developing roll is added on the downstream side of the developing roll 9 in the direction of rotation of the photoconductor 1 in FIG. 2. When the direction of rotation of the third developing roll is made the same as that of the developing roll 9, an image density of 1.4 in terms of optical density can be obtained.

What is claimed is:

1. An electrophotographic apparatus comprising:

a photoconductor; and two developing rollers facing the photoconductor, wherein a developer fed out from between the two developing rollers is supplied to the photoconductor by the two developing rollers to form a toner image on the photoconductor, wherein the developer includes a carrier having a volume-average particle size less than 70 μm and a volume resistivity of at least $10^6$ Ω·cm, wherein a volume ratio of the carrier in a facing portion between the photoconductor and the developing rollers is in a range of 30% to 46%, wherein the carrier has a volume resistivity of at least $10^{12}$ Ωcm when an intensity of an applied electric field is 1000 V/cm and a volume resistivity of equal to or less than $10^{10}$ Ωcm when the intensity of the applied electric field is 10000 V/cm.

2. The electrophotographic apparatus according to claim 1, wherein the carrier has a surface coated with a resin.

3. The electrophotographic apparatus according to claim 1, wherein the carrier has a surface coated with a resin having an electrically conductive material.

4. The electrophotographic apparatus according to claim 1, wherein the carrier has a core material comprising iron powder, said iron powder comprising iron oxide as a main component.

5. The electrophotographic apparatus according to claim 1, wherein the carrier has a core material comprising a ferrite carrier, said ferrite carrier including a metal oxide other than iron oxide as a subsidiary component.

6. The electrophotographic apparatus according to claim 5, wherein the ferrite carrier comprises a magnesium ferrite carrier, said magnesium ferrite carrier comprising magnesium oxide as a subsidiary component.

7. The electrophotographic apparatus according to claim 1, wherein the carrier has a core material comprising a binder carrier, said binder carrier comprising one of:

a kneaded iron powder-resin product; and a kneaded ferrite fine powder-resin product.

8. The electrophotographic apparatus according to claim 1, wherein said two developing rolls rotate in different directions.

9. The electrophotographic apparatus according to claim 1, wherein said two developing rolls comprise:

a first developing roll; and a second developing roll formed underneath said first developing roll, wherein said first developing roll rotates such that a moving direction of a surface of said first developing roll is reverse to a moving direction of a surface of said photoconductor; and wherein said second developing roll rotates such that a moving direction of a surface of said second developing roll is that of the moving direction of said surface of said photoconductor.

10. A developer for an electrophotographic apparatus, comprising:

a toner; and a carrier, said carrier having a volume-average particle size smaller than 70 μm, a volume resistivity of at least $10^6$ m, a volume resistivity of at least $10^{12}$ Ωm when an intensity of an applied electric field is 1000 V/cm, and a volume resistivity of equal to or less than $10^{10}$ Ωm when the intensity of the applied electric field is 10000 V/cm.

11. The developer according to claim 10, wherein said electrophotographic apparatus comprises:

two developing rolls for distributing said two-component developer;

a conveyance roll for carrying said two-component developer to said two developing rolls;

a limiting member for carrying said two-component developer from said two developing rolls to a photoconductor; and a blade for removing an excess amount of said two-component developer, said excess amount returned to said developing device.

12. The developer according to claim 11, wherein said two developing rolls rotate in different directions.

13. The developer according to claim 11, wherein said two developing rolls comprise:

a first developing roll; and a second developing roll formed underneath said first developing roll, wherein said first developing roll rotates such that a moving direction of a surface of said first developing roll is reverse to a moving direction of a surface of said photoconductor; and wherein said second developing roll rotates such that a moving direction of a surface of said second developing roll is that of the moving direction of said surface of said photoconductor.

14. The developer according to claim 10, wherein the carrier has a surface coated with a resin.

15. The developer according to claim 10, wherein the carrier has a surface coated with a resin comprising an electrically conductive material.

16. The developer device according to claim 10, wherein the carrier comprises a core material comprising iron powder, said iron powder comprising iron oxide as a main component.

17. The developer according to claim 10, wherein the carrier has a core material comprising a ferrite carrier, said ferrite carrier including a metal oxide other than iron oxide as a subsidiary component.

18. The developer according to claim 17, wherein the ferrite carrier comprises a magnesium ferrite carrier, said magnesium ferrite carrier comprising magnesium oxide as a subsidiary component.

19. The developer according to claim 10, wherein the carrier comprises a core material comprising a binder carrier, said binder carrier comprising one of:

a kneaded iron powder-resin product; and a kneaded ferrite fine powder-resin product.

* * * * *